US005188466A

United States Patent [19]

Kasper

[11] Patent Number: 5,188,466

[45] Date of Patent: Feb. 23, 1993

[54] MATRIX PIN PRINT HEAD WITH REBOUND CONTROL

[75] Inventor: Horst M. Kasper, Warren, N.J.

[73] Assignee: Mannesmann Aktiengesellschaft, Düsseldorf, Fed. Rep. of Germany

[21] Appl. No.: 722,519

[22] Filed: Jun. 27, 1991

[51] Int. Cl.[5] ..... B41J 2/27

[52] U.S. Cl. ..... 400/124; 400/167

[58] Field of Search ..... 400/124, 167; 101/93.02, 93.05

[56] References Cited

U.S. PATENT DOCUMENTS

| | | | |
|---|---|---|---|
| 4,613,243 | 9/1986 | Rossi et al. | 400/124 |
| 4,647,236 | 3/1987 | Moriya et al. | 400/124 |
| 4,697,939 | 10/1987 | Ara | 400/124 |
| 4,757,760 | 7/1988 | Nihara et al. | 400/124 |
| 4,787,760 | 11/1988 | Nagasawa | 400/167 |
| 4,822,187 | 4/1989 | Guyel | 400/124 |
| 4,886,381 | 12/1989 | Kersey | 400/124 |
| 5,000,593 | 3/1991 | Gugel et al. | 400/124 |
| 5,080,510 | 1/1992 | Stempfle et al. | 400/124 |

FOREIGN PATENT DOCUMENTS

| | | | |
|---|---|---|---|
| 61588 | 4/1982 | Japan | 400/124 |
| 126672 | 8/1982 | Japan | 400/124 |
| 203566 | 12/1982 | Japan | 400/124 |
| 2375 | 1/1985 | Japan | 400/124 |
| 255452 | 12/1985 | Japan | 400/124 |
| 255453 | 12/1985 | Japan | 400/124 |
| 153156 | 1/1988 | Japan | 101/93.02 |
| 153157 | 1/1988 | Japan | 101/93.02 |

*Primary Examiner*—David A. Wiecking
*Attorney, Agent, or Firm*—Horst M. Kasper

[57] ABSTRACT

The invention relates to a matrix print head (1) which is set at a fixed distance to a substrate support (2), where a recording substrate (3) is supported on the substrate support (2). An ink ribbon (4) is led between print pins (5) of a matrix pin print head (1) and the recording substrate (3), with a drive (6) provided jointly to the print pins (5) or to each print pin individually. In each case an electromagnetic coil (8) belongs to each print pin (5) and each print pin (5) is movable back and forth within a stroke from a rearward position into a forward position.

32 Claims, 4 Drawing Sheets

MATRIX PIN PRINT HEAD WITH REBOUND CONTROL

BACKGROUND OF THE INVENTION

1. Field of the Invention

The invention relates to a matrix pin print head, which is set at a fixed distance to a substrate support, where a recording substrate is supported on the substrate support, where an ink ribbon is led between print pins of a matrix pin print head and the recording substrate, with a drive provided jointly to the print pins or to each print pin individually and where in each case an electromagnetic coil belongs to each print pin, and wherein each print pin is movable back and forth within a stroke from a rearward position into a forward position.

A particular structure of this kind further includes that each print pin is operated by a clapper armature, wherein all clapper armatures rest at their inner ends in a rear rest position with a radially inner flap support end on the armature disposed at a joint face and wherein the drive force is transferred to the clapper armature through a radially outer clapper armature end, and wherein the path of each print pin corresponds to the clapper armature stroke path at one of said inner ends into a front print position.

2. Brief Description of the Background of the Invention Including Prior Art

Such matrix pin print heads for matrix pin printers are known from the U.S. Pat. No. 4,230,038 for providing a setting of all armatures on a single operating air gap and from the German printed Patent Document DE-OS 3,412,855 for the rigid setting of the operating air gap between magnet yoke and clapper armature.

Modern matrix print heads are presently operating with needle frequencies from about 1000 to 3000 Hertz. The print pin and its drive element are therefore to be furnished with a mass as low as possible, for allowing a higher speed operation for a certain energy input into the print pin.

In the past the guiding of the needle led to the generation of substantial frictional energy losses which energy losses attenuated the needle momentum and interfered with the impact speed of the needle. These frictional energy losses, however, were welcome in a certain way because these frictional energy losses led to a damping of the rearward motion during return of the needle into the original position.

SUMMARY OF THE INVENTION

1. Purposes of the Invention

It is an object of the present invention to provide a matrix pin printer, where the mass of the matrix pins can be held as small as possible, wherein the frictional energy losses of the matrix pins during operation can be kept as small as possible, and wherein the operational frequency of the matrix pin print head is increased.

It is a further object of the present invention to provide a matrix pin print head which can be constructed and operated employing components having smaller dimensions as compared with a conventional matrix pin print head.

It is yet a further object of the present invention to provide a matrix pin print head exhibiting a reduced overall mass to be carried by a print head carriage as compared with conventional matrix pin print head structures.

These and other objects and advantages of the present invention will become evident from the description which follows.

2. Brief Description of the Invention

The present invention provides for a matrix print head including electromagnetic drive means. A clapper armature is magnetically associated with and driven by the electromagnetic drive means. A print pin is connected to an end of the clapper armature to be advanced from a rearward position to a forward position by the driven clapper armature. A spring is connected to the clapper armature and furnished with energy by transforming part of the drive energy of the clapper armature into elastic energy of the spring and storing this energy for providing a recoil energy to the print pin and to the clapper armature. A first spherical segment body is disposed neighboring to said end of the clapper armature on a side of the clapper armature opposite to the side where the print pin is disposed relative to the clapper armature for receiving the linear momentum and the kinetic energy of the recoiling print pin and clapper armature.

A stop can limit the motion of the first spherical segment calotte body in advance direction of the print pin. A spherical segment calotte element can be disposed on the end of the clapper armature connected to the print pin and disposed for engaging the first spherical segment body and for providing an effective kinetic energy transfer from the clapper armature to the first spherical segment body. A support pin can be attached to the first spherical segment body and can extend relative to the first spherical segment body in a direction perpendicular to the advance direction of the print pin Guide means can restrain a motion of the first spherical segment body to a direction substantially parallel to the direction of movement of the print pin.

A second spherical segment body can contact the first spherical segment body in a rest position of the first calotte body and of the second spherical segment body for receiving linear momentum and kinetic energy from the first spherical segment body upon a recoil of the clapper armature and of the print pin.

Damping and restoring means can be connected to the second spherical segment body for rapidly restoring the second spherical segment body into rest position adjacent to the first spherical segment body immediately upon an energy transfer to the second spherical segment body from the first body.

A second support pin can be attached to the second spherical segment body and can extend relative to the second spherical segment body in a direction perpendicular to the advance direction of the print pin.

A rear pin can be attached to the rear of the second spherical segment body. A second spring can surround the rear pin for restoring the second spherical segment body to a rest position.

A rear pin can be attached to the second body. A cylinder element can be attached to an end of the rear pin. A second spring can be disposed adjacent to the cylinder element and be constrained to provide a restoring force for recoiling a second spherical segment body moving rearwardly.

A method for operating a print pin in a matrix pin printer comprises the following steps. A clapper armature is driven with an electromagnetic drive. A print pin is advanced with the clapper armature. Part of the drive energy furnished to the print pin is stored in a spring means. A print substrate impacts with the print pin. The print pin and clapper armature recoil with the energy stored in the spring. The kinetic energy of the print pin and the clapper armature is substantially transferred to a first spherical segment body.

The kinetic energy of the first spherical segment body can be transferred to a second spherical segment body.

The present invention print head includes means for accelerating a print pin during a forward motion into a forward impact position. Upon reaching of a final forward impact position, the direction of motion of the pin has to be reversed and the pin has to be accelerated in a rearward direction, for example, by a restoring spring which drives the pin a rearward direction. The pin attached to the clapper armature then moves backward and comes to rest based on a stop furnished in the base structure of the magnet head. In view of the relatively large mass of the base structure, there is generated a certain rearward recoil force, which recoil force leads to vibrations in the system containing the clapper armature and the print pin. It is desirable to avoid these vibrations because these vibrations lead to an uncertainty in the position of the print pin and of the clapper armature following an operation of the print pin. Furthermore, there occurs a delay in the readiness of the print pin and the clapper armature for a next following cycle of printing.

The present invention provides that the recoiling energy, which is furnished to the pin and the clapper armature in general by a spring, is transformed initially into elastic energy and then the elastic energy is transferred to a second elastic body as perfectly as possible based on the principles of Newtonian mechanics. Such a perfect transfer is difficult for such a system, in principle, because neither a purely linear moment nor a purely rotary moment is present. The guiding of the print pins substantially results in a linear motion, while the movement of the clapper armature can be approximated by a rotary motion. However, the linear motion of the print pin and the rotary motion of the clapper armature can be approximated by a joint linear momentum, which momentum has a direction substantially parallel to the direction of the print pin motion according to the laws of inertia and which joint linear momentum has its center of motion in the neighborhood of the connection point between print pin and clapper armature The clapper armature is furnished at its bottom side with a highly elastic element, which has a shape of a spherical segment and, in particular, of a ball-shaped spherical segment and is designated in the following as spherical segment element. The mass of the elastic first spherical segment body corresponds approximately to or is less than the mass of the clapper armature and of the pin. The first spherical segment body is furnished with a fist ball-shaped spherical segment surface in the area to be impacted by the calotte surface of the clapper armature. The first spherical segment surface of the elastic first spherical segment body is disposed opposite to the spherical segment of the clapper armature. The spherical segment of the clapper armature and the first spherical segment surface contact in the rest position of the clapper armature. The first calotte body is furnished with a second spherical segment surface, which is disposed on that side of the spherical segment body which side is disposed opposite to the first spherical segment shaped surface. The spherical segment of the clapper armature and the first spherical segment surface are disposed such that a middle, radially directed line through the surface of the spherical segment of the clapper armature in each case will coincide with a corresponding radially directed line through the spherical segment surface of the first spherical segment body and, through the second spherical segment surface of the first spherical segment body, respectively. These radial lines represent in each case lines perpendicular to the contact tangent planes of respective spherical segment surfaces.

A second spherical segment body is disposed neighboring the first spherical segment body and situated on the side of the first spherical segment body opposite relative to the armature position. The second spherical segment body is furnished with a spherical segment -shaped surface, which spherical segment-shaped surface contacts the lower, second spherical segment-shaped surface of the first spherical segment body in the rest position.

The second spherical segment body is movable in a rearward direction away from the first spherical segment body with the rear side advancing. However, care is taken that the initial motion of the second spherical segment body, upon being impacted by the first spherical segment body, is performed without substantial friction and/or counter forces, and wherein, however, upon an initial motion substantial damping and restoring forces are promptly affecting and modifying the motion of this second spherical segment body.

The invention structure operates such that the print pin, running and recoiling together with the clapper armature in a backward direction, transfers its motion energy and its linear momentum completely to the first spherical segment body and that the first spherical segment body then elastically transfers this motion energy and this linear momentum to this second spherical segment body, and that this motion energy and linear momentum is accepted by the second spherical segment body, where it is then damped and dissipated by the second spherical segment body. This operation involves a conversion of motion energy into elastic energy and a substantially complete transfer of the linear momentum of the armature together with its print pin, such that the armature and the print pin momentarily come to rest. The energy of motion of the armature and of the print pin is, upon impact on to the first spherical segment surface, transformed into elastic energy, which is transferred to the first spherical segment body, followed by transformation of the elastic energy into mechanical energy of the first spherical segment body. The first spherical segment body substantially maintains its rest position by impacting the second spherical segment body. Thereby, the energy of motion is transferred to the second spherical segment body, which starts to move and which then dissipates this imparted energy to damping agents.

The returning of the second spherical segment body to its rest position can be performed with a recoil force such as provided by a spring. The recoil force takes care that this second spherical segment body returns back into its initial rest position.

Furthermore, support and stop elements are provided which prevent the first spherical segment body and the second spherical segment body from moving beyond a certain point in the direction toward the print pin. In view of the transfer of the kinetic energy of motion from the clapper armature and the print pin to the first spherical segment body, the clapper armature and the print pin assume immediately the rest position after recoiling from a print impact without relying on friction forces derived from the guiding of the print pin and/or of the clapper armature The spring, which represents the restoring force for the print pin, is dimensioned such that the force transferred to the pin becomes, for all practical purposes, zero at a point in time where and as soon as the clapper armature comes in contact with the first spherical segment body. This construction allows that smaller friction values braking the print pin motion ca be considered in the guiding of the print pin.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
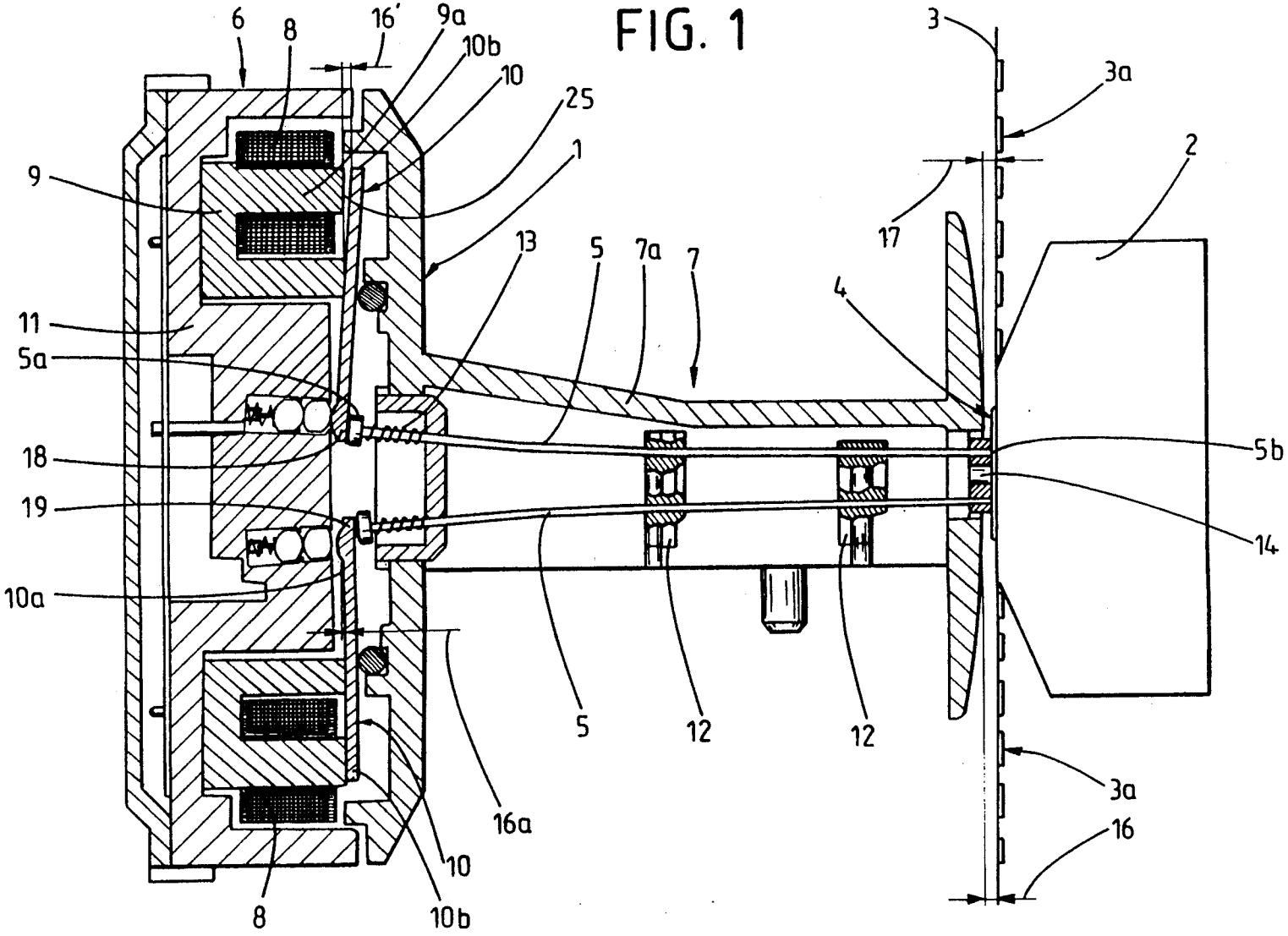
FIG. 1 is a longitudinal sectional view through a matrix pin print head with work air gaps between clapper armature and magnet yoke surface in two different positions of the clapper armature.

In accordance with the present invention there is provided a matrix pin print head adjustable to a fixed distance 17 relative to a substrate support 2. A recording substrate 3 rests on the substrate support 2. An ink ribbon 4 is led in front of print pins 5 between the matrix pin print head 1 and the recording substrate 3. Drives g, 10 are furnished coordinated to the print pins 5 jointly or individually to each print pin 5. An electromagnetic coil 8 is associated to each drive. Each print pin 5 is movable within a stroke path 16 from a rearward position 18 into a forward position 19 and back. In each case the fed-in drive energy for each print pin 5 is transformed into a recoiling energy by a restraining means formed by a spring 13. The recoiling energy is transferred to a body 101 with mechanical properties approximating those of print pin 5 and clapper armature 10 initially as elastic energy and then the elastic energy in turn is transformed into mechanical energy in the spherical segment body 101.

The clapper armature 10 can be furnished with a spherical segment surface 150 at its one end in the neighborhood of the contact section to the print pin 5, on that side of the armature 10 disposed opposite to the position of the print pin 5. This spherical segment surface 150 can be disposed adjacent to a first spherical segment body such that the linear momentum and the kinetic energy is transferred from a motion of the armature 10 to the first spherical segment body 101. Kinetic energy and the linear momentum can be transferred from the first spherical segment body 101 to a second spherical segment body 102 upon a recoiling of the print pin 5. The first and the second spherical segment body 101, 102 can be led movably in a guide borehole 105 disposed in a base body of the print head. The first and the second spherical segment body 101, 102 can each be supported by a side support rod 121, 126. The side support rod 121, 126 in each case can be disposed substantially in a direction parallel to an elongation direction of the clapper armature 10 in the rest position. The support rod of the first spherical segment body 101 and of the second spherical segment body 102 can be fixed in a direction parallel to the elongation direction of the armature 10.

A rod 142 can bè attached at the second calotte body 102 in the direction of motion of a recoiling print pin 5 at that side of the second spherical segment body 102 disposed opposite to a contact point 162 with the first spherical segment body 101.

Damping means 113, 125, 132 can damp the motion of the second spherical segment body 102 and can then bring the second spherical segment body 102 back into its rest position.

A restoring spring 113 of the second spherical segment body 102 can exert in the rest position a small restoring force, which rises rapidly upon deflection of the second spherical segment body 102 from the rest position.

The restoring force of a spring 13 of the print pin 5 in the rest position of the print pin can exert a small force onto the print pin, wherein the restoring force rapidly rises upon deflection of the print pin 5 from the rest position.

In accordance with the invention, the matrix pin print head 1 is disposed at a fixed distance 17 relative to a substrate support 2. A recording substrate 3 rests fully at the substrate support 2. The fixed distance 17 is set during final assembly of the printer in the production facilities after an assembly of the matrix pin print head 1. An ink ribbon 4 is led between the matrix pin print head 1 and the recording substrate 3. A number of, for example, 9, 18, or 24 or more print pins 5 will impact the ink ribbon in order to generate the print dots of characters or of graphics on the recording substrate.

In principle, the matrix pin print head 1 is subdivided into two functional groups, namely, in a drive group 6 for the print pins 5 and in a print pin guiding group 7. The drive group 6 comprises an electromagnetic coil 8 with a magnet yoke, and a clapper armature 10 coordinated and driving each respective print pin. The drive group 6 is mounted on a base plate 11. The print pin guide group 7, comprising a pin casing **7*a* and several pin guide supports 12, is disposed in the print pin casing 7*a***.

Each print pin 5, therefore, is substantially subjected to frictional forces based on the guiding in the pin guide support 12 as well as by a support of the print pin head **5*a*. Each print pin 5 is subjected to a spring force by a spring 13 and, in addition, to a friction force associated with a guiding of the print pins 5 in a guide mouthpiece 14. The spring 13 is constructed such that when he print pin is disposed in its rest position, then the spring force is small or negligible. The spring 13 is substantially relaxed in a position corresponding to a rest position of the print pin. The spring force of the spring 13 rapidly increases with the forward motion of the print pin from the rest position. The drive energy, fed to each print pin by the clapper armature, furnishes the print impact force of the respective print pin 5 less energy losses, generated by the friction and less energy transferred to the spring 13**.

The embodiment illustrated in FIG. 1 effects a rearward position of a print pin 5 as long as the electromagnetic coil 8 is not fed with current. The clapper armature 10 is disposed in a rearward rest position 18. A certain drive energy and a certain stroke path 16 is associated with each drive pin and the stroke path is usually between 0.05 to 0.4 millimeters. The drive energy, imparted on the print pin during this stroke path 16 in the kind of motion energy, determines the impact force of the print pin tip 5*b*.

The following rearward motion of the print pin 5 is performed substantially by a force, which is stored in the spring 13 and said force moves and effects the rearward motion of the print pin 5 and armature 10. The deflection of the impacting print pin 5 from the ink ribbon and print substrate provides additional return motion energy. The armature 10 with the spherical segment element 110 contacts and impacts with its contact point 160 on the first surface 151 of the first spherical segment body 101 and then an elastic deformation of the spherical segment element 110 of the clapper armature 10 occurs in the neighborhood of the contact point 161 with the first spherical segment body 101. The first spherical segment body 101 is to have similar mechanical properties as the print pin 5 and the clapper armature 10, where the mass of the first spherical segment body 101 is such relative to the clapper armature 10 and to the print pin 5 that simultaneously a linear momentum and kinetic energy can be transferred from the clapper armature 10 and the print pin 5 to the first spherical segment body 101. Since the first spherical segment body 101 has a mass, which substantially corresponds in its mass inertia to the sum of the mass of the print pin 5 and of the clapper armature 10, or which is less in its mass inertia to the sum of the mass of the print pin 5 and of the clapper armature 10, the energy of motion and the linear momentum are substantially transferred from the print pin 5 and the clapper armature 10 to the first spherical segment body 101. In other words, the following relations hold for the transfer: $(mv^2)$ print pin $+(mv^2)$ clapper armature$=(mv^2)$ first spherical segment body $(mv)$print pin $+(mv)$ clapper armature$=(mv)$ first spherical segment body, where m is the mass and v is the velocity of the respective element.

The energy transfer is particularly advantageous, where the contact between the spherical segment element 110 of the clapper armature 10 and the first spherical segment body 101 occurs at a curved surface which leads to a symmetric distribution of the elastic forces over a spherical segment shape and which entails a particularly advantageous transfer of the elastic energy. This transfer of the elastic energy is comparable to the transfer of elastic energy which occurs, for example, in the course of a billiard game. After the energy is transferred to the first spherical segment body 101, then the second surface 152 of the first spherical segment body 101 impacts and engages in a forced contact with the first surface 153 of the second spherical segment body 102 and transfers the energy of motion and the linear momentum to the second spherical segment body 102 via an intermediate energy form of elastic energy. In order that this process can be performed, it is necessary that the first spherical segment body 101 and the second spherical segment body 102 are retained in a standard rest position, which is prepared for the impact of the pin 5 and of the clapper armature 10 to be restored into the rest position onto the first spherical segment body 101.

Figure 2:
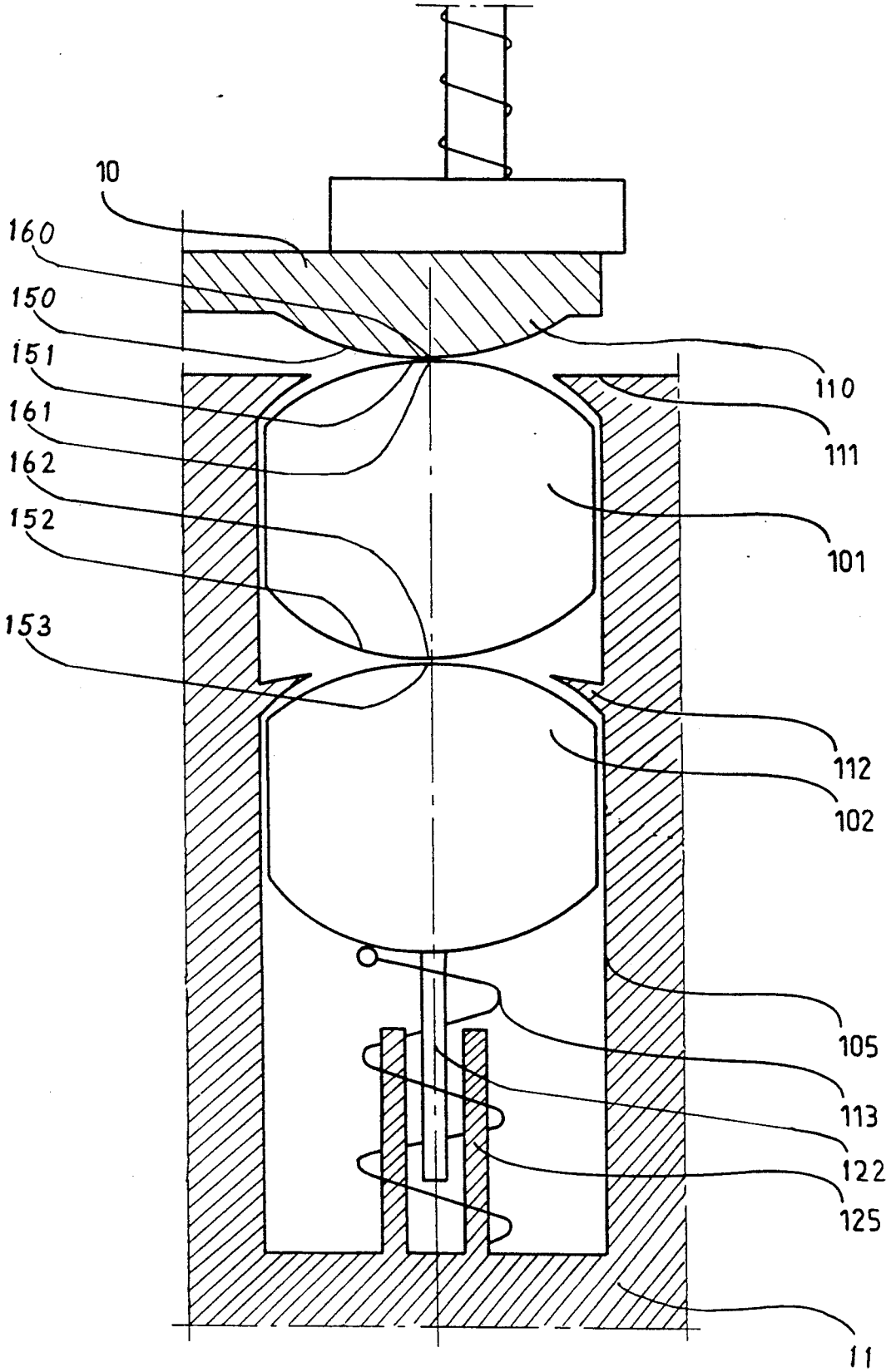
FIG. 2 illustrates an enlarged, in part sectional view of a detail of the embodiment of FIG. 1 in the area of the engagement between a clapper armature and the base.

FIGS. 1 and 2 illustrate such constructions, wherein the spherical segment bodies 101 and 102 are placed within a guide borehole 105, and wherein the direction of the guide borehole 105 corresponds to the direction of the linear momentum of the clapper armature 10 and of the print pin 5. First noses 111 and second noses 112 are furnished at the guide borehole 105 of the spherical segment bodies. The noses 111 and 112 provide stops for the first spherical segment body 101 and, respectively, the second spherical segment body 102 such that the first spherical segment body 101 and the second spherical segment body 102 can move only up to certain defined positions in the direction toward the print pin 5. In case of the embodiment of FIG. 2, the second spherical segment body 102 is furnished additionally with a rear pin 122, which is disposed on the opposite side of the second spherical segment body 102 relative to the first spherical segment body 101, and which rear pin 122 is directed in parallel to the direction of the guide borehole 105. The guide borehole 105 is furnished with a tubular projection 125, attached at the bottom of the guide borehole 105. The tubular projection 125 is adapted such that the pin 122 can move within this tubular projection.

A spring 113 is furnished, which provides the restoring force for moving the second spherical segment body 102 into the rest position. The force of the spring 113 is relatively small when the rest position of the second spherical segment body 102 is present in order to allow a complete transfer of the linear momentum and of the energy of motion from the first spherical segment body 101 to the second spherical segment body 102. The linear extension of the spring 113 is smaller than the linear extension of spring 13 in the rest position. If, however, the second spherical segment body 102 has started to move, then the restoring force of the spring 113 rises quickly. The restoring force of the spring 113 is dimensioned such that a quick return of the second spherical segment body 102 to the rest position is effected within the frequency cycle of the print pin drive. The pin 122 moves in the tubular projection 125 and leads to frictional energy losses and a damping of the motion of the second spherical segment body 102.

Figure 3:
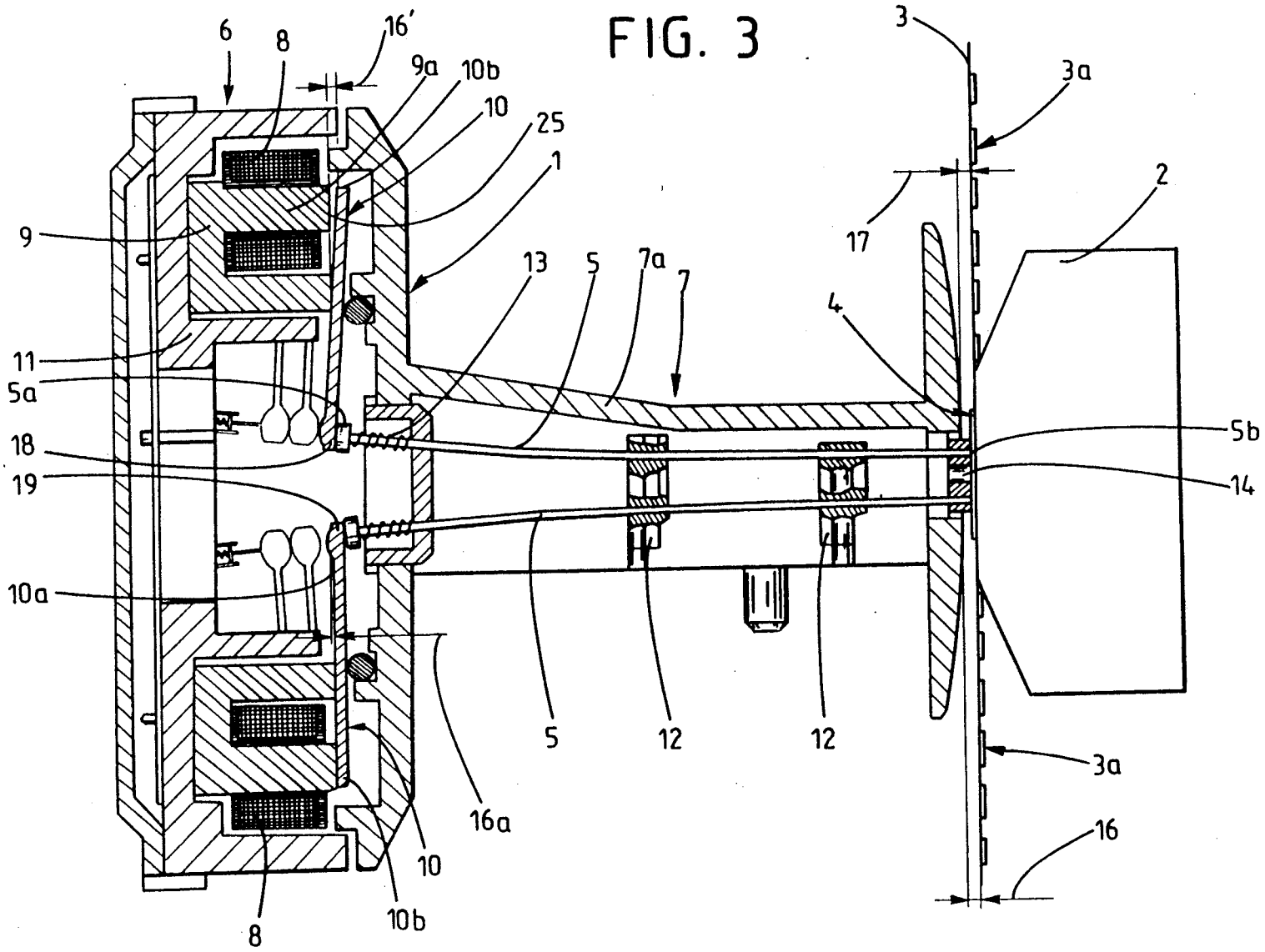
FIG. 3 shows a longitudinal section through a second embodiment of a matrix pin print head with working air gaps between clapper armature and magnet yoke surface in different positions of the clapper armature.
Figure 4:
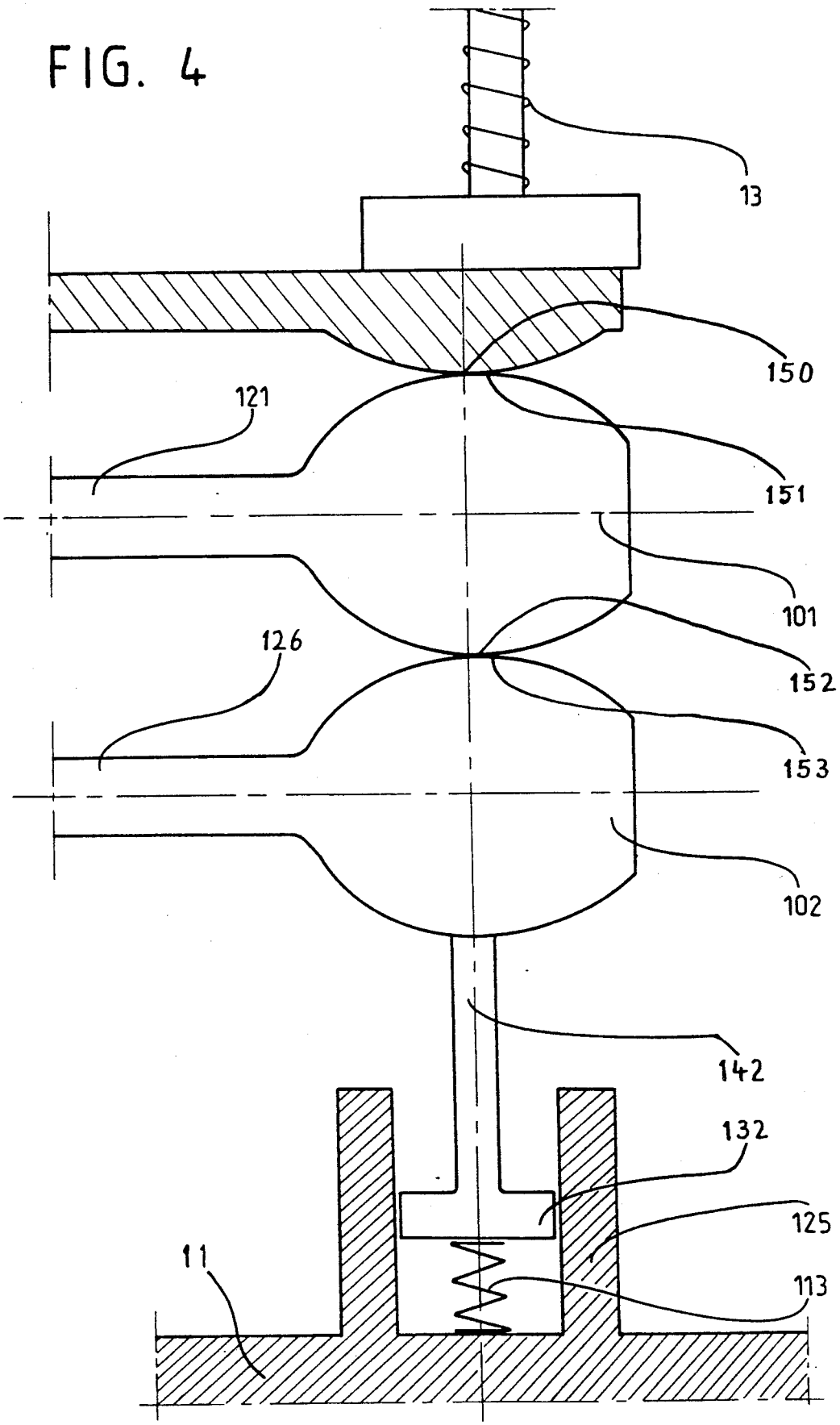
FIG. 4 is an enlarged, in part sectional view of a detail of the embodiment of FIG. 3 in the area of the clapper armature.

A further embodiment of the invention is illustrated in FIGS. 3 and 4. The spherical segment bodies 101 and 102 are held by support rods 121 and 126 in this case instead of providing, according to the FIGS. 1 and 2, support for spherical segment bodies 101 and 102 by way of the guide borehole 105. The support by support rods 121 and 126 allows the mechanical behavior of the spherical segment body 101 to be easier adapted to the mechanical behavior of the print pin 5 and of the clapper armature 10, because not only a linear momentum can be transferred to the spherical segment body 101 supported in this way but, in addition, a torque can be transferred based on the elastic support of the spherical segment bodies 101, 102 by the respective support rods 121, 126. Correspondingly, the spherical segment bodies 101 and 102 are disposed such that they can fully receive the linear momentum and the torque from the print pin 5 and from the clapper armature 10.

The spherical segment body 102 of FIG. 4 is furnished with a pin 142 similar to the pin 122 of spherical segment body 102 of FIG. 2. In this case however, the pin 142 carries a cylinder element 132 at the end. The cylinder element 132 moves within a tubular projection 125 which extends to the base 11 of the matrix pin print head. The spring 113 does not directly rest at the second spherical segment body 102 in case of the embodiment of FIG. 4, but instead is confined between the cylinder element 132 and the floor of the tubular projection 125. This construction allows, in general, to employ a smaller diameter spring 113 and second, there occurs a larger damping force because of the friction caused by an escape of air between the cylinder element 132 and the tubular projection 125.

The arrangement of FIGS. 3 and 4 allows to transfer the largest part of the linear momentum and of the kinetic energy from the print pin 5 and from the clapper armature 10 onto the first spherical segment body 101 and then onto the second spherical segment body 102.

The presence of the second spherical segment body 102 ensures that the first spherical segment body 101 substantially retains its rest position and that a stable position of the clapper armature 10 and of the print pin 5 is achieved quickly and without delay and oscillations after a return into the rest position from an impact position based on the force of the spring 113.

It will be understood that each of the elements described above, or two or more together, may also find a useful application in other types of print heads differing from the types described above.

While the invention has been illustrated and described as embodied in the context of a matrix pin print head it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A matrix print head comprising electromagnetic drive means;

a clapper armature magnetically associated with and driven by the electromagnetic drive means and including a spherical segment element disposed near an end of the clapper armature;

a print pin for contacting an end of the clapper armature to be advanced from a rearward position to a forward position by the driven clapper armature;

a spring engaged with the print pin and furnished with energy by transforming part of the drive energy of the clapper armature into elastic energy of the spring and storing this energy for providing a recoil energy to the print pin and to the clapper armature;

a first spherical segment body disposed neighboring to said spherical segment element near said end of the clapper armature on a side of the clapper armature opposite to the side where the print pin is disposed relative to the clapper armature for being impacted and accelerated by the recoiling print pin and clapper armature resulting in an acceleration of the first spherical segment body relative to the print head and for receiving the linear momentum and the kinetic energy of the recoiling print pin and clapper armature.

2. The matrix print head according to claim 1, further comprising a stop limiting the motion of the first spherical segment body in advance direction of the print pin.

3. The matrix print head according to claim 1, wherein the spherical segment element is disposed on the end of the clapper armature connected to the print pin and disposed for engaging the first spherical segment body for providing an effective kinetic energy transfer from the clapper armature to the first spherical segment body.

4. The matrix print head according to claim 1, further comprising a support pin attached to the first spherical segment body and extending relative to the first calotte body in a direction perpendicular to the advance direction of the print pin.

5. The matrix print head according to claim 1, further comprising guide means restraining a motion of the first spherical segment body to a direction substantially parallel to the direction of movement of the print pin.

6. The matrix print head according to claim 1, further comprising a second spherical segment body contacting the first spherical segment body in a rest position of the first spherical segment body and of the second spherical segment body for receiving linear momentum and kinetic energy from the first spherical segment body upon a recoil of the clapper armature and of the print pin.

7. The matrix print head according to claim 6, further comprising damping and restoring means connected to the second spherical segment body for rapidly restoring the second spherical segment body into a rest position adjacent to the first spherical segment body immediately upon an energy transfer to the second spherical segment body from the first spherical segment body.

8. The matrix print head according to claim 6, further comprising a second support pin attached to the second spherical segment body and extending relative to the second spherical segment body in a direction perpendicular to the advance direction of the print pin.

9. The matrix print head according to claim 1, wherein the first spherical segment body is furnished with a first ball-shaped surface in the area to be impacted by the spherical segment surface of the clapper armature.

10. The matrix print head according to claim 1, wherein a first spherical segment surface of the first spherical segment body is disposed opposite to the spherical segment element of the clapper armature.

11. The matrix print head according to claim 1, wherein the spherical segment element of the clapper armature and a first spherical segment surface of the first spherical segment body contact in the rest position of the clapper armature.

12. The matrix print head according to claim 11, wherein the first spherical segment body is furnished with a second spherical segment surface disposed on a side opposite to the first spherical segment surface.

13. The matrix print head according to claim 1, wherein the spherical segment element is furnished with a spherical segment surface, wherein the spherical segment surface is disposed adjacent to the first spherical segment body in the rest position of the clapper armature.

14. The matrix print head according to claim 1, wherein the clapper armature with a contact point of the spherical segment element contacts a first spherical segment surface of the first spherical segment body in a rest position of the armature, wherein during recoiling the clapper armature with the contact point of the spherical segment element impacts the first spherical segment surface of the first spherical segment body causing thereby an elastic deformation of the spherical segment element in the neighborhood of the contact point with the first spherical segment surface of the first spherical segment body.

15. The matrix print head according to claim 1, wherein the a curved surface of the spherical segment element of the clapper armature and a curved surface of the first spherical segment body are contacting each other in a rest position of the clapper armature resulting in a symmetric distribution of elastic forces over the respective spherical shape and entailing an advantageous transfer of elastic energy between the curved surface of the spherical segment element and the curved surface of the first spherical segment body.

16. The matrix print head according to claim 1, wherein the spherical segment element of the clapper armature and the first spherical segment surface of the first spherical segment body are disposed such that a middle, radially directed line through the surface of the spherical segment element of the clapper armature in each case will coincide with a corresponding radially directed line through the first spherical segment surface of the first spherical segment body, wherein these radial lines represent lines perpendicular to contact tangent planes of respective spherical segment surfaces.

17. The matrix print head according to claim 1, wherein the first spherical segment body is furnished with a first ball-shaped surface in the area to be impacted by the spherical segment surface of the clapper armature;

wherein the first spherical segment surface of the elastic first spherical segment body is disposed opposite to the segment of a sphere of the clapper armature;

wherein the spherical segment element is furnished with a spherical segment surface, wherein the spherical segment surface is disposed adjacent to the first spherical segment body in the rest position of the clapper armature;

wherein the spherical segment element of the clapper armature and the first spherical segment surface of the first spherical segment body are disposed such that a middle, radially directed line through the surface of the spherical segment element of the clapper armature in each case will coincide with a corresponding radially directed line through the first spherical segment surface of the first spherical segment body, wherein these radial lines represent lines perpendicular to contact tangent planes of respective spherical segment surfaces;

wherein the clapper armature with a contact point of the spherical segment element contacts a first spherical segment surface of the first spherical segment body in a rest position of the armature, wherein during recoiling the clapper armature with the contact point of the spherical segment element impacts the first spherical segment surface of the first spherical segment body causing thereby an elastic deformation of the spherical segment element in the neighborhood of the contact point with the first spherical segment surface of the first spherical segment body resulting in a symmetric distribution of elastic forces over the respective spherical shape and entailing an advantageous transfer of elastic energy between the curved surface of the spherical segment element and the curved surface of the first spherical segment body.

18. A matrix print head comprising electromagnetic drive means;

a clapper armature magnetically associated with and driven by the electromagnetic drive means;

a print pin for contacting an end of the clapper armature to be advanced from a rearward position to a forward position by the driven clapper armature;

a spring for contacting the clapper armature and furnished with energy by transforming part of the drive energy of the clapper armature into elastic energy of the spring and storing this energy for providing a recoil energy to the print pin and to the clapper armature;

a first spherical segment body disposed neighboring to said end of the clapper armature on a side of the clapper armature opposite to the side where the print pin is disposed relative to the clapper armature for receiving the linear momentum and the kinetic energy of the recoiling print pin and clapper armature;

a second spherical segment body contacting the first spherical segment body in a rest position of the first spherical segment body and of the second spherical segment body for receiving linear momentum and kinetic energy from the first spherical segment body upon a recoil of the clapper armature and of the print pin;

a rear pin attached to the rear of the second spherical segment body.

19. The matrix pin print head according to claim 18, further comprising a second spring surrounding the rear pin for restoring the second spherical segment body to a rest position.

20. The matrix pin print head according to claim 18, further comprising a cylinder element attached to an end of the rear pin; a second spring disposed adjacent to the cylinder element and constrained to provide a restoring force for recoiling a second spherical segment body moving rearwardly.

21. A matrix pin print head adjustable to a fixed distance (17) relative to a substrate support (2), wherein a recording substrate (3) rests on the substrate support (2), wherein an ink ribbon (4) is led in front of the print pins (5) between the matrix pin print head (1) and the recording substrate (3), wherein drives (9,10) are furnished contacting the print pins (5) jointly or individually to each print pin (5), wherein an electromagnetic coil (8) and a clapper armature (10) is associated to each drive, wherein each print pin (5) and clapper armature (10) is movable within a stroke path (16) from a rearward position (18) into a forward position (19) and back, wherein the clapper armature is furnished with a spherical segment element near an end of the clapper armature, wherein in each case the fed-in drive energy for each print pin (5) is substantially transformed into a recoiling energy by restoring means (13) and wherein the recoiling energy is substantially transferred to a first spherical segment body (101) being engaged by the spherical segment element of the clapper armature, wherein the first spherical segment body is furnished with mechanical properties approximating those of the respective print pin (5) and clapper armature (10), wherein the recoiling energy is initially transferred as elastic energy and then the elastic energy in turn is transformed into mechanical energy in the first spherical segment body (101) thereby moving the spherical segment body (101) relative to the printhead.

22. A matrix pin print head according to claim 21, wherein the clapper armature (10) is furnished with a spherical segment surface (110) at its one end in a neighborhood of the contact section to the print pin (5), on that side of the armature (10) disposed opposite to the position of the print pin (5), wherein this spherical segment surface (110) is disposed adjacent to the first spherical segment body such that the linear momentum and the kinetic energy is transferred from a motion of the armature (10) to the first spherical segment body (101).

23. The matrix pin print head according to claim 22, wherein a second spherical segment body (102) is present, wherein kinetic energy and the linear momentum are transferred from the first spherical segment body (101) to the second spherical segment body (102) upon a recoiling of the print pin (5).

24. The matrix pin print head according to claim 23, wherein the first and the second spherical segment body (101, 102) are led movably in a guide borehole (105) disposed in a base body of the print head.

25. The matrix pin print head according to claim 21 wherein the restoring force of the restoring means (13) of the print pin (5) in the rest position of the print pin exerts a small force onto the print pin, wherein the restoring force rapidly rises upon deflection of the print pin (5) from the rest position.

26. A matrix pin print head head adjustable to a fixed distance (17) relative to a substrate support (2)

wherein a recording substrate (3) rests on the substrate support (2), wherein an ink ribbon (4) is led in front of the print pins (5) between the matrix pin print head (1) and the recording substrate (3);

wherein drives (9,10) are furnished coordinated to the print pins (5) jointly or individually to each print pin (5);

wherein an electromagnetic coil (8) and a clapper armature (10) is associated to each drive, wherein each print pin (5) and clapper armature (10) is movable within a stroke path (16) from a rearward position (18) into a forward position (19) and back;

wherein in each case the fed-in drive energy for each print pin (5) is substantially transformed into a recoiling energy by restoring means (13);

wherein the recoiling energy is substantially transferred to a first spherical segment body (101) with mechanical properties approximating those of the respective print pin (5) and clapper armature (10) initially as elastic energy and then the elastic energy in turn is transformed into mechanical energy in the first spherical segment body (101); wherein the clapper armature (10) is furnished with a spherical segment surface (110) at its one end in the neighborhood of a contact section to the print pin (5), on that side of the armature (10) disposed opposite to the position of the print pin (5);

wherein this spherical segment surface (110) is disposed adjacent to a first spherical segment body such that the linear momentum and the kinetic energy is transferred from a motion of the armature (10) to the first spherical segment body (101);

wherein a second spherical segment body (102) is present; wherein kinetic energy and the linear momentum are transferred from the first spherical segment body (101) to the second spherical segment body (102) upon a recoiling of the print pin (5);

wherein the first and the second spherical segment body (101, 102) are each supported by a side support rod (121, 126);, wherein the side support rod (121, 126) in each case is disposed substantially in a direction parallel to an elongation direction of the clapper armature (10) in the rest position; and wherein the support rod of the first spherical segment body (101) and of the second spherical segment body (102) are fixed in a direction parallel to the elongation direction of the armature (10).

27. A matrix pin print head adjustable to a fixed distance (17) relative to a substrate support (2);

wherein a recording substrate (3) rests on the substrate support (2), wherein an ink ribbon (4) is led in front of the print pins (5) between the matrix pin print head (1) and the recording substrate (3);

wherein drives (9,10) are furnished coordinated to the print pins (5) jointly or individually to each print pin (5);

wherein an electromagnetic coil (8) and a clapper armature (10) is associated to each drive, wherein each print pin (5) and clapper armature (10) is movable within a stroke path (16) from a rearward position (18) into a forward position (19) and back;

wherein in each case the fed-in drive energy for each print pin (5) is substantially transformed into a recoiling energy by restoring means (13);

wherein the recoiling energy is substantially transferred to a first spherical segment body (101) with mechanical properties approximating those of the respective print pin (5) and clapper armature (10) initially as elastic energy and then the elastic energy in turn is transformed into mechanical energy in the first spherical segment body (101); wherein the clapper armature (10) is furnished with a spherical segment body surface (110) at its one end in the neighborhood of a contact section to the print pin (5), on that side of the armature (10) disposed opposite to the position of the print pin (5);

wherein this spherical segment surface (110) is disposed adjacent to a first spherical segment body such that the linear momentum and the kinetic energy is transferred from a motion of the armature (10) to the first spherical segment body (101);

wherein a second spherical segment body (102) is present; wherein a rod (122) is attached at the second spherical segment body (102) in the direction of motion of a recoiling print pin (5) at that side of the second spherical segment body (102) disposed opposite to a contact point (162) with the first spherical segment body (101).

28. The matrix pin print head according to claim 27, wherein a restoring spring (113) is furnished and wherein damping means (113, 125, 132) are provided, which damp the motion of the second spherical segment body (102) and which then bring the second spherical segment body (102) back into its rest position.

29. The matrix pin print head according to claim 27, wherein a restoring spring (113) of the second spherical segment body (102) exerts in the rest position a small restoring force, which rises rapidly upon deflection of the second spherical segment body (102) from the rest position.

30. A method for operating a print pin in a matrix pin printer, comprising:

driving a clapper armature having a spherical segment element disposed near an end of the clapper armature with an electromagnetic drive;

advancing a print pin with the clapper armature;

storing part of the drive energy furnished to the print pin in a spring means;

impacting a print substrate with the print pin;

recoiling the print pin and clapper armature with the energy stored in the spring;

substantially transferring the kinetic energy of the print pin and the clapper armature by impacting a first spherical segment body with the spherical segment element of the clapper armature.

31. The method according to claim 30, further comprising transferring the kinetic energy of the first spherical segment body to a second calotte body.

32. A matrix print head comprising electromagnetic drive means;

a clapper armature magnetically associated with and driven by the electromagnetic drive means and including a spherical segment element disposed near an end of the clapper armature;

a print pin for contacting an end of the clapper armature to be advanced from a rearward position to a forward position by the driven clapper armature;

a spring engaged with the print pin and furnished with energy by transforming part of the drive energy of the clapper armature into elastic energy of the spring and storing this energy for providing a recoil energy to the print pin and to the clapper armature;

a first spherical segment body disposed neighboring to said spherical segment element near said end of the clapper armature for being impacted by the recoiling print pin and clapper armature resulting in an acceleration of the first spherical segment body relative to the print head and for receiving the linear momentum and the kinetic energy of the recoiling print pin and clapper armature.

* * * * *